United States Patent [19]

Thompson

[11] 3,987,846

[45] Oct. 26, 1976

[54] WELLHEAD SHUT-OFF VALVE

[75] Inventor: Dennis C. Thompson, Edmonton, Canada

[73] Assignee: Exxon Production Research Company, Houston, Tex.

[22] Filed: July 3, 1975

[21] Appl. No.: 592,845

[52] U.S. Cl. ..... 166/84; 166/226

[51] Int. Cl.[2] ..... E21B 43/00

[58] Field of Search ..... 166/84, 95, 96, 97, 166/72, 226; 251/318, 319

[56] References Cited

UNITED STATES PATENTS

| | | | |
|---|---|---|---|
| 1,871,319 | 8/1932 | Griswold et al. | 166/72 |
| 2,517,655 | 8/1950 | Gillespie | 166/82 |
| 3,500,907 | 3/1970 | Gentry | 166/84 |
| 3,817,327 | 6/1974 | Grable et al. | 166/72 |

*Primary Examiner*—James A. Leppink
*Attorney, Agent, or Firm*—Robert L. Graham; Salvatore J. Casamassima

[57] ABSTRACT

An improved sucker rod pumping system for an oil well includes a valve member mounted in the rod string, a valve seat formed in the wellhead, and means for moving the rod string upwardly to cause the valve member to sealingly engage the valve seat. The valve member is located on the rod string such that during normal pumping operation, it will not contact the valve seat or otherwise interfere with the pumping operations. When it is desired to close in the well or inject a fluid therein, the rod string is elevated above its normal stroke until the valve member sealingly engages the valve seat.

5 Claims, 2 Drawing Figures

WELLHEAD SHUT-OFF VALVE

BACKGROUND OF THE INVENTION

1. Field of the Invention

This invention relates to an improved shut-off valve for a sucker rod pumping system used in oil wells. In one aspect, the invention relates to an improved sucker rod pumping system for wells which are periodically subjected to injection of a heated fluid such as steam.

2. Description of the Prior Art

In the thermal stimulation of oil wells, a subterranean, oil-bearing formation in the immediate vicinity of the wellbore is heated to reduce oil viscosity and improve near wellbore permeability by removal of fines and asphaltic deposits. The technique involves basically two steps: (1) an injection phase wherein steam or other hot fluid is injected down the well into the formation, followed by (2) an oil production phase wherein formation fluids are flowed or pumped from the formation up the well. Since the main benefit of steam stimulation is due to reductions in crude viscosity, this technique is normally applied in wells completed in reservoirs producing low API gravity crudes. These wells normally are produced by artificial means such as rod pumping systems.

In rod pump systems, a subsurface reciprocating pump is located near the producing formation and a rod string, referred to as sucker rod string, extends from the subsurface pump to the surface. At the surface the top joint of the rod string, referred to as a polished rod, extends through a stuffing box of the wellhead and attaches to a pumping unit. The pumping unit, which may be a mechanical pumping jack or a hydraulic actuator, imparts reciprocal movement to the rod string which operates the piston or plunger of the subsurface pump.

The stuffing box includes soft packing which provides a dynamic seal for the reciprocating polished rod.

A problem associated with sucker rod pumping systems as applied in wells which are periodically subjected to thermal stimulation, is that the packing in the stuffing box cannot be exposed to the high pressure or high temperature thermal fluids. The conventional stuffing box performs satisfactorily during the production phase of the operation, but during the steam injection phase, the packing is incapable of providing a reliable seal for long periods of time. Most wells subjected to thermal stimulation in the past have been provided with high temperature shut-off valves referred to as blowout preventers. The blowout preventer is placed in the open position during the production phase of the operation. When it is desired to inject fluids down the well, the opposed rams of the blowout preventer are moved to the closed position which seal around the polished rod disposed therein. The blowout preventer, however, is expensive and not fully reliable because of the tendency of the polished rod to become worn or scored during the pumping phase of the operation. Moreover, the soft packing elements of the rams deteriorate in the presence of the hot injection fluids such that they frequently are incapable of establishing and maintaining a pressure seal about the polished rods.

SUMMARY OF THE INVENTION

The present invention provides for an improved valve assembly for closing off the wellhead of a sucker rod pumping system. The improved valve assembly includes a valve member mounted on the sucker rod string internally of the wellhead and a valve seat formed in the wellhead below the stuffing box. The valve is located in the rod string a sufficient distance below the valve seats so as not to interfere with the normal reciprocating pumping motion of the sucker rod string. Means are provided for raising the rod string above its normal stroke until the valve member sealingly engages the valve seat, thereby providing an effective seal between the sucker rod string and the wellhead. During normal pumping operation, the stuffing box provides the wellhead seal. During the thermal stimulation phase, however, the valve assembly constructed according to the present invention provides the seal. The valve member and valve seat are preferably constructed of a metal which is not affected by the high temperature fluids.

A preferred technique for effecting the seal during the injection phase involves elevating the sucker rod string by using the pumping jack and clamping the rod string in the elevated position by means of a conventional polish rod clamp. The rod string thus is suspended on the stuffing box such that unscrewing the stuffing box slightly will increase the engagement pressure of the valve member on the valve seat.

DESCRIPTION OF THE PREFERRED EMBODIMENTS

Figure 1:
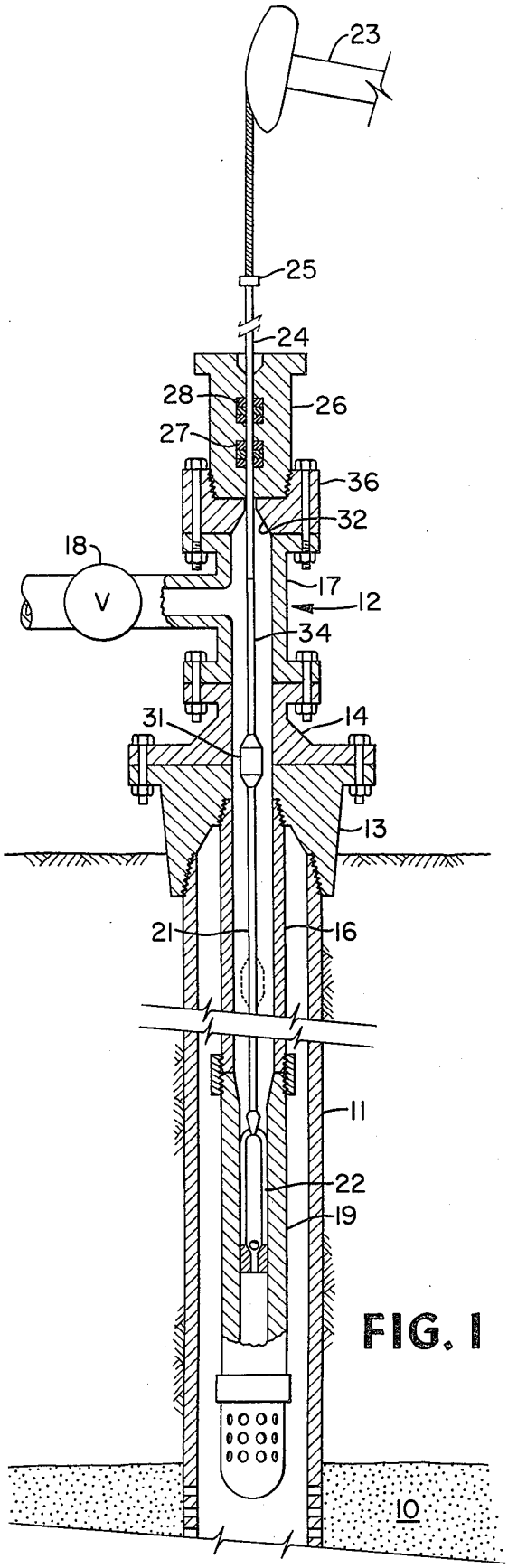
FIG. 1 is a vertical sectional view of a well equipped with a sucker rod pumping system which includes the improvement according to the present invention.

With reference to FIG. 1, a well extends from the surface to oil-bearing formation 10. In most completions, the well is provided with a casing 11 cemented in place and a wellhead 12. The wellhead 12 includes a casing head 13, tubing hanger 14 from which is suspended a tubing string 16, and a production tee 17. Connected to the side outlet of the production tee 17 is a wing valve 18. The well flow line or injection line may be connected to the wing valve 18.

In order to lift fluids from the producing formation 10 to the surface, a sucker rod pumping system is provided. This system includes a subsurface pump 19 located near the lower end of the tubing string 16, a sucker rod string 21 connected to the pump plunger or piston 22. The rod string 21 extends from the pump 19 to the surface and through the wellhead 12. The upper end of the rod string 21 is connected to means for reciprocating the rod string and pump. These means may take the form of a hydraulic pumping unit or, as illustrated, a pumping jack, a portion of which is shown as 23. The rod string 21 comprises mainly a plurality of sucker rods connected in end-to-end relation and a polished rod 24 which extends through the upper end of the wellhead 12 and connects to the pumping jack 23 by means of clamp 25. In order to accommodate the polished rod 24, the wellhead 12 includes a stuffing box 26 which provides a dynamic seal for the reciprocating polished rod 24. The stuffing box 26 may take a variety of forms, but most include soft packing which effectively seal around the reciprocating polished rod 24. In the embodiment illustrated, the stuffing box 26 is provided with two packings, 27 and 28. Each packing may include a plurality of stacked rings composed of neoprene, reinforced rubber, asbestos, or other suitable packing material.

As will be described in more detail below, the stuffing box packings 27 and 28 provide the fluid seal during the pumping phase of the operations but by virtue of the present invention, are not subjected to the high pressure fluid during the injection phase (if used).

In accordance with the present invention, the sucker rod pumping system includes an improved shutoff valve that can be quickly and effectively actuated when it is desired to shut in the well. The shutoff valve comprises companion parts: valve member 31 mounted in the rod string 21 and forming a part thereof, and a valve seat 32 formed in the wellhead below the stuffing box 26.

Although the valve member 31 and the companion valve seat 32 may take a variety of shapes and forms provided that a seal is effected when the former contacts the latter, it is preferred that they be constructed of materials to provide a metal-to-metal seal. Such a seal, thus, is not affected by the high temperature fluids injected during thermal stimulation. Suitable materials include steel or wear-resistant alloys.

Figure 2:
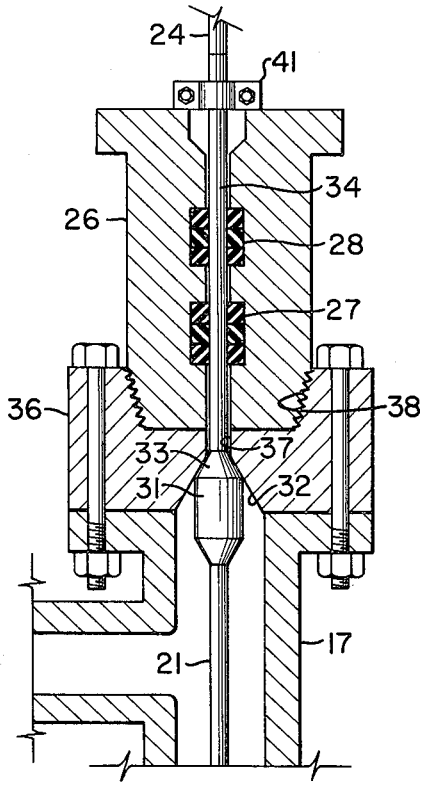
FIG. 2 is an enlarged, fragmentary view of the well shown in FIG. 1 illustrating the equipment in the closed-in condition.

As illustrated in FIG. 2, the valve member 31 may be circular in cross-section presenting an upwardly facing frusto-conical surface 33; and valve seat 32 may be a downwardly facing frusto-conical surface complementary to surface 33. The lower end of valve member 31 may be provided with threads for connecting to the sucker rod string. A shaft portion 34 extends above the frusto-conical surface 33 and is provided with threads for connection to the polished rod 24.

The valve seat surface 32 may be formed in a flange member 36 adapted to be connected to the upper end of production tee 17. The flange member 36 is provided with a central opening 37. The lower end of the opening 37 is tapered defining the valve seat surface 32 which, as pointed out above, is complementary shaped to the valve member surface 33. A threaded counterbore 38 is formed in the upper end of the flange 36 for receiving a lower threaded end of stuffing box 26.

The shaft 34 is exactly the same diameter of the polished rod 24 and the opening 37 is slightly larger than the diameter of these members to permit free passage.

The length of shaft 34 plus the polished rod 24 determines the position of the valve member 31. This length should be sufficient to prevent the valve member 31 from contacting valve seat 32 during normal pumping operations and also permit the plunger 22 to be retrieved from the pump barrel before member 31 contacts seat 32. Lengths in the order of 24 to 28 feet are satisfactory for most systems. If an insert pump is used, the length of the shaft can be much shorter, particularly if a bottom hold down pump is used. It should be noted that the valve member 31 may be constructed separately from the shaft 34. Also, the shaft 34 could be an integral part of the polished rod 24 with the valve member formed on the bottom of the polished rod 24. If a separate shaft 34 is utilized, it should be sufficiently long to reach above the stuffing box 26 and clamp 41 so that in the shut off position, a polished rod 24 can be replaced without having to remove the flange member 36. Generally, lengths in the order of 24–30 inches are satisfactory.

During the normal pumping operation in which the rod string and piston 22 are reciprocated by the pumping unit 23, the valve member 31 will reciprocate between an upper position (illustrated as the solid line position of FIG. 1) and the lower position (illustrated as the broken line position of FIG. 1). Fluids will thus be lifted through the tubing string 16 and discharged through wing valve 18 to the flow line or other surface facilities.

When it is desired to inject steam down the tubing 16 or casing 11 and into the formation 10, the pumping operations are interrupted and the equipment is moved to the closed position. This may be achieved simply by using the pumping jack 23 and polished rod clamps 41 and 25 for elevating the rod string 21 until valve member 31 engages valve seat 32. This operation may require incremental jacking of the rod string 21 by techniques wellknown to those skilled in the art. When the rod string 21 is elevated to cause the valve member 31 to contact valve seat 32, clamp 41 is secured to the rod string 21. Thus, the rod string 21 is supported on the stuffing box 26. The engagement pressure of the valve member 31 and the valve seat 32 may be increased by unscrewing the stuffing box 26 a fraction of a turn which will tend to elevate the valve member 31 relative to the flange member 36.

It should be noted also that elevating of the rod string will cause the piston 22 to be removed from the pump barrel permitting the downward flow of fluids through the tubing 16. Of course, if a tubing pump is used, the standing valve will have to be retrieved along with the piston 22. However, this is done routinely.

Following injection of the steam, the well is normally maintained in a closed-in position to permit the thermal effects to dissipate or soak the formation. The well may be returned to pumping condition by merely lowering the rod string to its initial position and resuming pumping operations.

It should be noted that a variety of means may be provided for moving the rod string to the steam injection position. For example, a hydraulic jack may be employed immediately below the polish rod clamps such that by means of a hand hydraulic pump, the rod string may be elevated to apply the proper seating force of the valve member 31 on the seating surface 32. Also a separate jack may be substituted for the polished rod, in which case the jack is mounted on the upper end of the stuffing box and includes means for exerting an upward pulling force on the rod string and valve member 31. The jack may be hydraulic or mechanical.

Although the present invention has been described specifically in connection with producing wells subjected to thermal stimulation, it will be appreciated by those skilled in the art that the invention may also be used in wells where it is desired to close in the well to replace packing in the stuffing box or do other remedial work at the surface.

It will be appreciated that several variations and modifications may be made in the embodiments described herein and still embody the inventive concept of providing a rod string with an internal shut-off valve.

I claim:

1. In a well having a wellhead, a subsurface reciprocating pump, a rod string extending from said pump through said wellhead, means for reciprocating said rod string and said pump, and packing in said wellhead for sealing around said rod string, the improvement comprising a valve member mounted on said rod string; valve seat means formed in said wellhead below said packing for receiving said valve member; and means for moving said valve member upwardly into sealing engagement with said valve seat means, said valve member being positioned on said rod string such that it does not contact said valve seat means during normal reciprocating operation of said rod string.

2. Apparatus as defined in claim 1 wherein said valve member and said valve seat means are made of metal.

3. Apparatus as defined in claim 1 wherein said valve member and said valve seat means define complementary surfaces.

4. Apparatus as defined in claim 1 wherein the means for moving said valve member upwardly include said means for reciprocating said rod string and said pump.

5. Apparatus as defined in claim 4 wherein said packing comprises a stuffing box and said means for moving said valve member includes a clamp for suspending said rod string on said stuffing box, and means for moving said stuffing box relative to said valve seat means.

* * * * *